United States Patent [19]

Takase et al.

[11] Patent Number: 4,495,923

[45] Date of Patent: Jan. 29, 1985

[54] FUEL INJECTION CONTROL SYSTEM

[75] Inventors: Sadao Takase; Akio Hosaka, both of Yokosuka, Japan

[73] Assignee: Nissan Motor Company, Limited, Yokohama, Japan

[21] Appl. No.: 349,867

[22] Filed: Feb. 18, 1982

[30] Foreign Application Priority Data

Feb. 20, 1981 [JP] Japan ..... 56-23132

[51] Int. Cl.[3] ..... F02B 3/00

[52] U.S. Cl. ..... 123/478; 123/480

[58] Field of Search ..... 123/478, 480, 485, 486, 123/489; 364/431, 571

[56] References Cited

U.S. PATENT DOCUMENTS

| | | | |
|---|---|---|---|
| 4,155,332 | 5/1979 | Yaegashi et al. | 123/480 |
| 4,181,944 | 1/1980 | Yawauchi et al. | 123/480 |
| 4,196,702 | 4/1980 | Bowler | 123/478 |
| 4,201,159 | 5/1980 | Kawai et al. | 123/480 |
| 4,202,295 | 5/1980 | Kondo et al. | 123/478 |
| 4,214,306 | 7/1980 | Kobayashi | 123/480 |
| 4,240,382 | 12/1980 | Reddy | 123/478 |
| 4,345,561 | 8/1982 | Kondo et al. | 123/478 |
| 4,369,650 | 1/1983 | Yamamoto et al. | 123/478 |

*Primary Examiner*—Raymond A. Nelli

*Attorney, Agent, or Firm*—Schwartz, Jeffery, Schwaab, Mack, Blumenthal & Koch

[57] ABSTRACT

A fuel injection control system is disclosed which generates a fuel-injection command pulse signal having a constant repetition rate and a pulse width calculated from an algebraic relationship defining fuel-injection pulse-width as a function of engine air flow. The system can eliminate the need for engine-speed calculations and increase system reliability.

4 Claims, 8 Drawing Figures

FUEL INJECTION CONTROL SYSTEM

BACKGROUND OF THE INVENTION

This invention relates to a fuel injection control system for controlling the flow of fuel from fuel injectors to an internal combustion engine and, more particularly, to such a system adapted to provide, to the fuel injectors, fuel-injection command pulses having a predetermined repetition rate and a pulse width calculated as a function of engine air flow.

Fuel injection control systems have been employed to control the flow of fuel from fuel injectors to an internal combustion engine by providing fuel-injection command pulses to the fuel injectors. The fuel-delivery requirement of the engine is calculated in the form of fuel-injection pulse-width and injection timing. The fuel-injection pulse-width is calculated from an algebraic relationship describing fuel-injection pulse-width as a function of engine air flow rate and engine speed. It is the common practice to meet the fuel-delivery requirements by providing, in synchronism with rotation of the engine crankshaft, fuel-injection command pulses, the pulse width of which corresponds to the flow of air supplied to the engine in each engine crankshaft rotation. However, this requires an engine-speed sensor for sensing the speed of rotation of the engine crankshaft, a reference pulse generator for generating pulses in synchronism with engine crankshaft rotation, and a data processing circuit therefor, leading to a relatively complex and unreliable fuel injection control system. Furthermore, a failure in the engine speed sensor, the reference pulse generator, or the data processing circuit will cause engine troubles.

The present invention provides an improved fuel injection control system which eliminates the above disadvantages found in conventional fuel injection control systems by providing fuel-injection command pulses having a predetermined repetition rate and a pulse width calculated as a function of engine air flow.

SUMMARY OF THE INVENTION

There is provided, in accordance with the present invention, a fuel injection control system for use in an internal combustion engine having at least one fuel injector. The system comprises an airflow sensor for generating a signal indicative of the flow rate of air to the engine, and a digital computer receiving the engine air flow rate indicative signal from the airflow sensor for reading engine air flow rate values at predetermined time intervals. The digital computer calculates a fuel-injection pulse-width value from the read engine air flow rate values. The system also comprises a trigger pulse generator for generating a series of trigger pulses at a predetermined repetition rate shorter than the period of rotation of the engine at its maximum speeds, and an injection command signal generator for generating an injection command pulse having a pulse width corresponding to the calculated fuel-injection pulse-width value to the fuel injector each time a trigger pulse comes thereto from the trigger pulse generator.

The digital computer calculates the fuel-injection pulse-width value by adding a predetermined number of engine air flow rate values successively read at the predetermined intervals. The trigger pulse generator generates trigger pulses at a predetermined repetition rate corresponding to the time interval during which the predetermined number of engine air flow rate values are added.

In an alternative embodiment, the system further comprises a reference pulse generator for generating a series of reference pulses in synchronism with engine rotation, a control signal generator for generating a control signal changeable between low and high levels, and a gate circuit having inputs from the trigger pulse generator and the reference pulse generator. The gate circuit responds to a high level control signal from the control signal generator for passing trigger pulses from the trigger pulse generator to the injection command signal generator. The gate circuit responds to a low level control signal from the control signal generator for passing reference pulses from the reference pulse generator to the injection command signal generator. The digital computer normally reads engine speed values from the reference pulses, calculates the fuel-injection pulse-width value by dividing the read air flow rate value by the read engine speed value, and holds the control signal at its low level. When a failure occurs in the reference pulse generator or the associated circuit, the digital computer changes the control signal to its high level and calculates the fuel-injection pulse-width value by adding a predetermined number of engine air flow rate values successively read at the predetermined intervals. The digital computer may change the control signal to its high level and calculates the fuel-injection pulse-width value by adding a predetermined number of engine air flow rate values when the repetition rate of the reference pulses exceeds a predetermined value.

BRIEF DESCRIPTION OF THE DRAWINGS

The details as well as other features and advantages of this invention are set forth below and are shown in the accompanying drawings, in which.

With reference now to the conventional fuel injection control system in the PRIOR ART figure, there is shown a digital computer A which communicates with an input circuit B and an output circuit C via a bidirectional data bus D. The input circuit B receives various inputs such as signals E, F and G indicative of engine air flow rate (engine air flow per unit time) Q, engine rotational speed N, and engine coolant temperature respectively, and an engine-rotation-synchronized pulse signal H. The input circuit B successively converts analog inputs into digital form and feeds them to the digital computer A via the data bus D. The digital computer A obtains a basic pulse width value $T_p$ proportional to engine air flow per one engine rotation which is calculated by dividing the engine air flow rate Q by the engine speed N. The digital computer obtains a fuel-injection pulse-width $T_i$ by correcting the basic pulse width value $T_p$ for engine coolant temperature. The fuel-injection pulse-width value $T_i$ is fed to the output circuit C which provides, in synchronism with the engine-rotation-synchronized pulse signal H, fuel-injection command pulses having a pulse width corresponding to the value $T_i$ to fuel injectors (not shown).

DETAILED DESCRIPTION OF THE PREFERRED EMBODIMENTS

Figure 1:
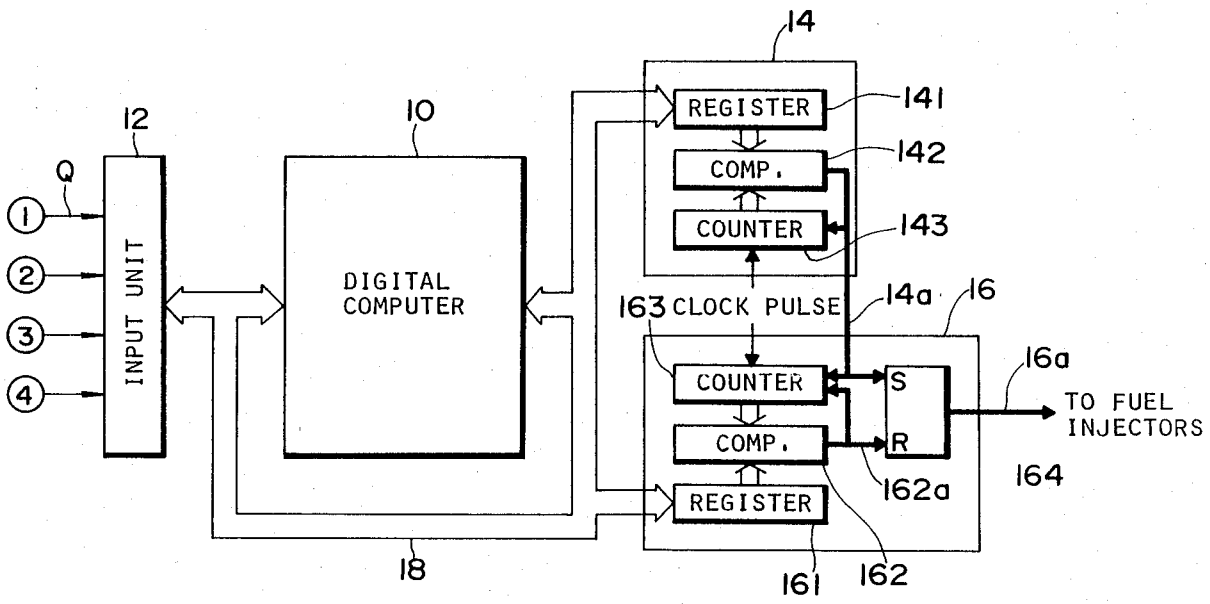
FIG. 1 is a schematic block diagram showing one embodiment of a fuel injection control system made in accordance with the present invention.

Turning now to FIG. 1, the fuel injection control system of the present invention is shown as including a digital computer 10, an input control unit 12, a trigger pulse generator 14, and an output control unit 16. The digital computer 10 communicates with the rest of the system via a bi-directional data bus 18.

The digital computer 10 includes a central processing unit (CPU), a read only memory (ROM), and a read/-write memory (RAM). The digital computer 10 performs arithmetic calculations, based upon various conditions of the engine that are sensed during engine operation, to determine the amount of fuel metered to the engine, the fuel-injection timing, and other required engine operating functions.

The input control unit 12 is shown as having analog inputs from an airflow sensor 1, a battery voltage sensor 2, a coolant temperature sensor 3, and an oxygen sensor 4. The airflow sensor generates a signal indicative of the flow rate of air to the engine (engine air flow rate), the battery voltage sensor generates a signal indicative of vehicle battery voltage, the coolant temperature sensor generates a signal indicative of cylinder-head coolant temperature, and the oxygen sensor generates a signal indicative of the concentration of oxygen in the engine exhaust. The input control unit 12 has an analog multiplexer and an analog-to-digital converter. The analog inputs to the multiplexer are, one by one, converted to the A/D converter into digital form. The A to D conversion process is initiated on command from the digital computer 10 which selects the input channel to be converted. At the end of the conversion cycle, the A/D converter generates an interrupt signal after which the data are read into the computer memory via the data bus 18 on command from the digital computer 10. The input control unit 12 may have switch closure input means which receives on-off signals from a starter switch and a throttle switch and reads the data into the computer memory via the data bus 18 on command from the digital computer 10. The input control unit 12 has timers for providing interrupt signals to the digital computer central processing unit.

The trigger pulse generator 14 has a timer circuit, which is shown as comprising a register 141, a comparator 142, and a counter 143, for generating a series of trigger pulses 14*a* at a predetermined frequency or at a predetermined repetition rate. The register 141 stores, on command from the digital computer, a predetermined value which corresponds to the repetition rate of the trigger pulse signal 14*a*. The counter 143 receives clock pulses and counts up from zero at a predetermined rate. The comparator 142 resets the counter 143 to zero and at the same time generates a trigger pulse 14*a* each time the value of the count in the counter reaches the value stored in the register 141.

The output control unit 16 comprises a register 161, a comparator 162, a counter 163, and an R/S flip-flop 164. The register 161 stores, on command from the digital computer 10, a value which corresponds to the fuel-injection pulse-width value $T_i$ calculated by the digital computer as will be described in detail. The counter 163 receives clock pulses and starts counting up from zero at a predetermined rate in response to a trigger pulse 14*a* from the trigger pulse generator 14. The trigger pulse 14*a* is also coupled to the set terminal S of the flip-flop 164. The comparator 162 resets the counter 163 to zero and at the same time provides a reset signal 162*a* to the reset terminal R of the flip-flop 164 each time the value of the count in the counter 163 reaches the value stored in the register 161. The flip-flop 164 is set with the generation of the trigger pulse 14*a* from the trigger pulse generator 14 and is reset with the generation of the reset signal 162*a* from the comparator 162. Thus, the flip-flop 164 generates a fuel-injection command signal 16*a* having a pulse width corresponding to the value stored in the register 161 and a repetition rate corresponding to the value stored in the registor 141. The fuel-injection command signal 16*a* is applied to fuel injectors for controlling the flow of fuel to the engine.

Figure 2:
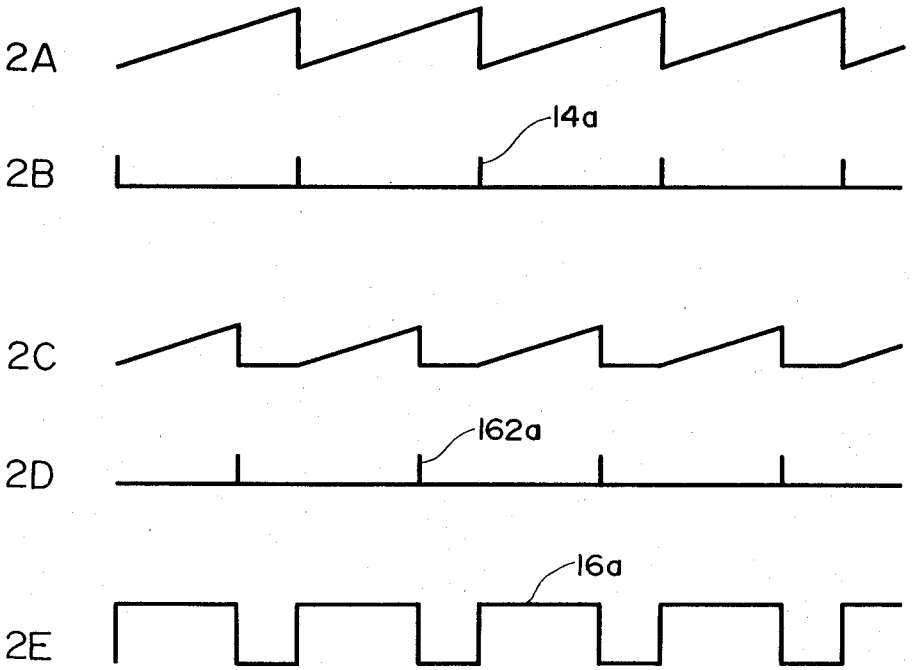
FIG. 2 contains five figures 2A, 2B, 2C, 2D and 2E showing three waveforms obtained at various points in the schematic diagram of FIG. 1 in connection with changes in the count value of two counters.

With particular reference now to FIG. 2, there are shown three voltage-versus-time waveforms for the signals 14*a*, 162*a*, and 16*a* in connection with changes in the values of the count in the counters 143 and 163. FIG. 2A illustrates changes in the value of the count in the counter 143 included in the trigger pulse generator 14 and FIG. 2B illustrates the trigger pulses 14*a* produced by the comparator 142 of the trigger pulse generator 14. The count value increases at a predetermined rate until it reaches the value which is stored in the register 141 on command from the digital computer 10. When the count value reaches the value, the count value falls to zero and starts increasing. At the same time, the comparator 142 generates a trigger pulse 14*a*. The time interval between the occurrence of successive trigger pulses 14*a* is dependent upon the value stored in the register 141.

FIG. 2C illustrates changes in the value of the count in the counter 163 included in the output control unit 16 and FIG. 2D illustrates the reset signal 162*a* produced by the comparator 162 included in the output control unit 16. The count value increases at a predetermined rate until it reaches the value which is determined by the digital computer 10 and stored in the register 161. When the count value reaches the value, the count value falls to zero and the comparator 162 generates a reset pulse 162*a*. The count value remains at zero until the counter 163 receives a trigger pulse 14*a* from the trigger pulse generator 14 and thereafter increases again.

FIG. 2E illustrates the fuel-injection command signal 16*a* applied from the output control unit 16 to the fuel injectors. When the flip-flop 164 receives at its set terminal S a trigger pulse 14*a* from the trigger pulse generator 14, the fuel-injection command signal 16*a* at the output terminal of the flip-flop shifts to a high level and remains in that state until a reset signal 162*a* is applied from the comparator 162 to the reset terminal R of the flip-flop 164. Upon the generation of the reset signal 162*a*, the fuel-injection command signal changes from its high level to a low level and remains in that state until a trigger pulse 14*a* is applied again to the set terminal S of the flip-flop. The time interval during which the fuel-injection command signal 16a remains at its high level is dependent upon the value stored in the register 161 and the one cycle of the fuel-injection command signal is dependent upon the value stored in the registor 141. Thus, the fuel-injection command signal 16a has a duty ratio corresponding to the register 161 value divided by the register 141 value.

FIG. 3 contains three flow diagrams illustrative of the operation of the digital computer 10 used to arithmetically calculate values for the fuel-delivery requirements in the form of fuel-injection pulse-width and injection timing.

Figure 3A:
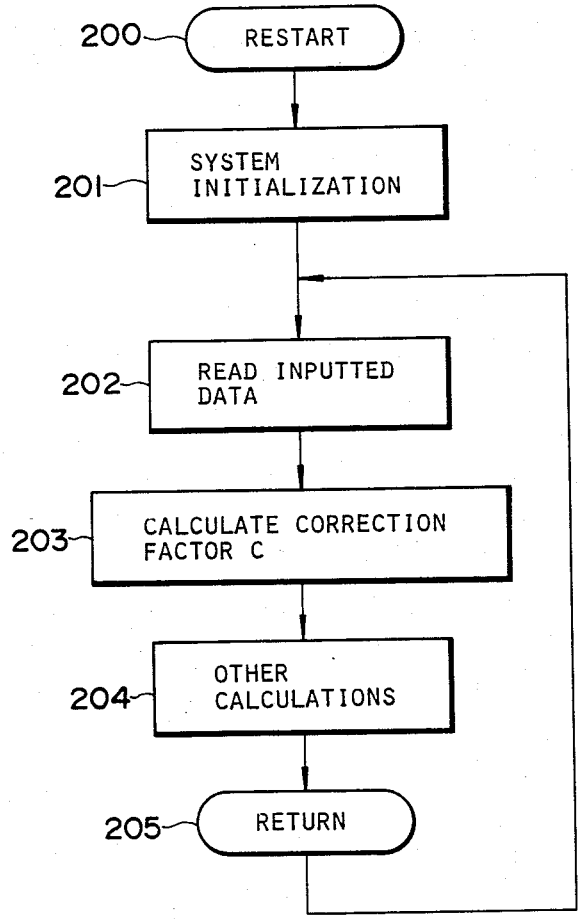
FIGS. 3A, 3B and 3C are flow diagrams illustrative of the operation of the digital computer used in the system of FIG. 1 to arithmetically calculate values for the fuel-delivery requirements in the form of fuel-injection pulse-width and injection timing.

FIG. 3A is a flow diagram of the programming of the digital computer which starts with a RESTART point 200 upon closure of a power switch to reset the system. At the point 201 in the program, the system is initialized to ensure that all indicators and constants are set to prescribed conditions and values before the routine is obeyed. The process at this point may include setting a stack pointer, clearing RAM locations, and the like. After the system initialization, at the point 202, the values for the sensed engine operating parameters are read into the computer memory. At the point 203 in the program, a fuel-injection pulse-width correction factor C for engine coolant temperature, exhaust gas oxygen content, vehicle battery voltage, engine acceleration, engine deceleration, and the like is arithmetically calculated by the digital computer. At the point 204, the digital computer calculates the required EGR valve position, spark timing, and other engine operating variables except for fuel-injection pulse width. The process at the point 204 may include outputting the calculated values and checking the sensors used to sense the required engine operating parameters. At the termination of the process at the point 204, the program proceeds to a point 205 which returns the program to the beginning of the point 202.

Figure 3B:
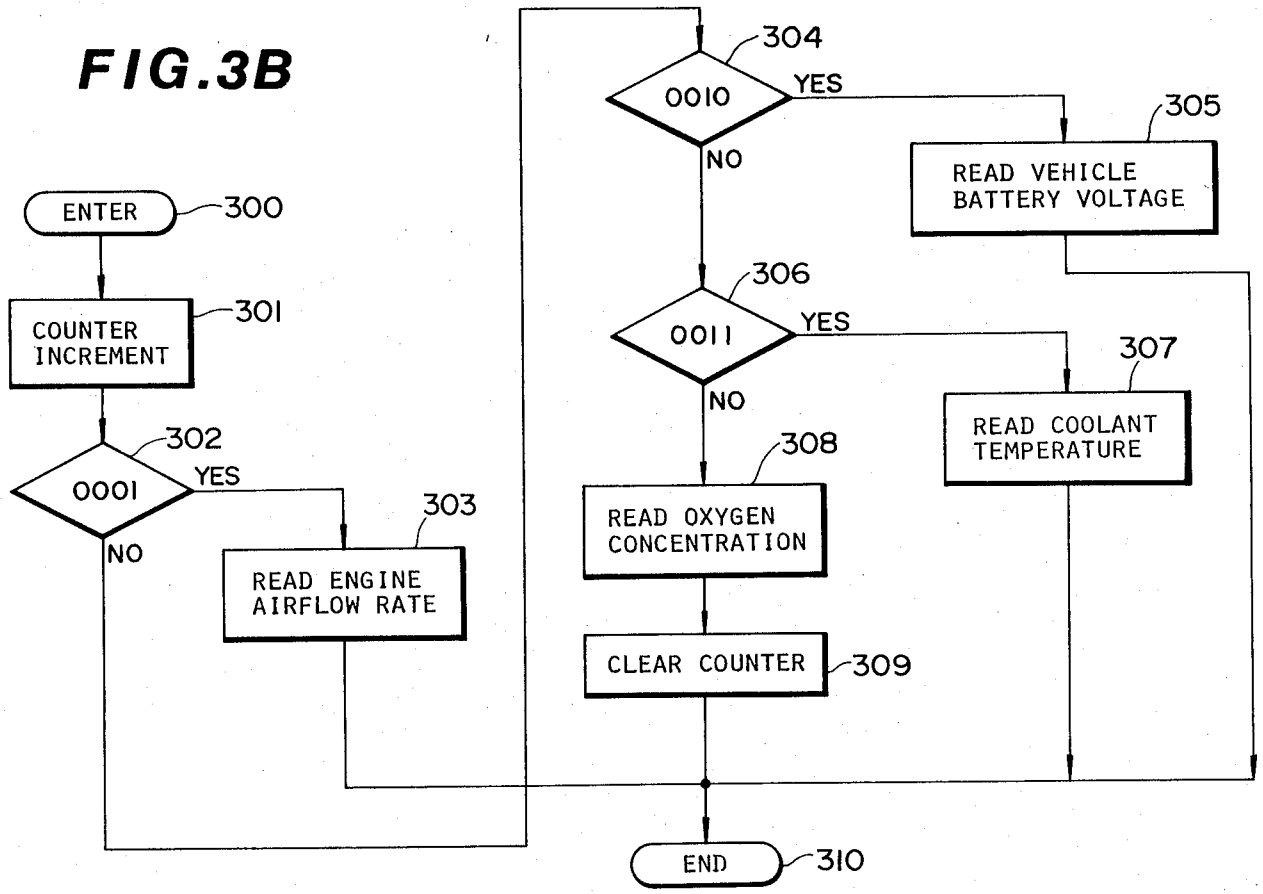

FIG. 3B is a flow diagram of the programming of the digital computer wherein the various inputs to the analog multiplexer are successively converted by the A/D converter into digital form and read into the computer memory. The computer program is entered at the point 300 upon occurrence of an interrupt signal which is generated from the input control unit timer to the digital computer central processing unit at predetermined time intervals. At the point 301 in the digital computer central processing unit increments a counter used in the computer memory. After the counter increment, the program proceeds to a determination step at a point 302. The determination at the point 302 is whether or not the value of the count in the counter is the binary number 0001. If the answer to this question is yes, then the program proceeds to the point 303 wherein the engine air flow rate indicative signal is converted to digital form and read into the computer memory. If the answer to this question is no, then at the point 304 another determination is made as to whether or not the count value is the binary number 0010. If the answer to this question is yes, then the program proceeds to a point 305 wherein the vehicle battery voltage indicative signal is converted to digital form and read into the computer memory. If the answer to this question is no, then at the point 306, another determination is made. The determination is whether or not the count value is the binary number 0011. If the answer to this question is yes, then the program proceeds to a point 307 wherein the coolant temperature indicative signal is converted to digital form and read into the computer memory. Otherwise, the program proceeds to a point 308 wherein the exhaust gas oxygen concentration indicative signal is converted to digital form and read into the computer memory. Following this, the program proceeds to a point 309 wherein the counter is cleared, and then to the end point 310.

Figure 3C:
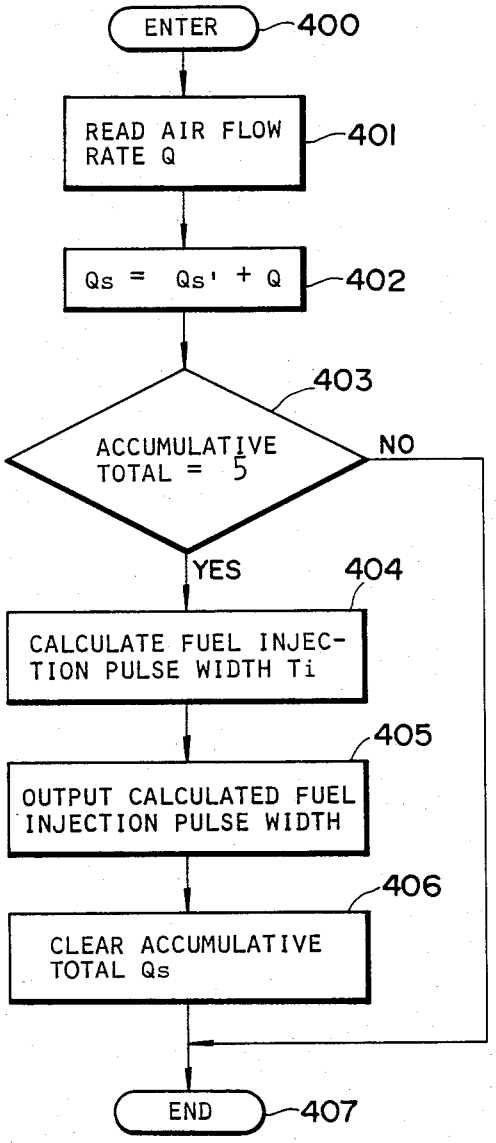

FIG. 3C is a flow diagram of the programming of the digital computer for calculating a fuel-injection pulse-width value $T_i$. The computer program is entered at the point 400 upon occurrence of an interrupt signal from the input control unit timer that is generated at a predetermined frequency. At the point 401 in the program, the engine air flow rate value Q is read and then at the point 402 the digital computer central processing unit calculates an accumulative engine air flow rate Qs' by adding the read engine air flow rate value Q to the previous accumulative engine air flow rate value Qs'. Following this, the program proceeds to a determination step at a point 403. The determination is whether or not the accumulative total of the number of times that the engine air flow rate values were added is a predetermined value which may be five as shown in the diagram although there is not intention to be limited to such a value. If the answer to this question is no, the program proceeds to an end point 407. If the answer to the question is yes, the program proceeds to a point 404 wherein the digital computer central processing unit arithmetically calculates a fuel-injection pulse-width value $T_i$ by multiplying the calculated accumulative engine air flow rate value Qs' by the correction factor C which is calculated at the point 203 of the FIG. 3A program. At the point 405, the calculated fuel-injectin pulse-width value $T_i$ is outputted. Following this, the program proceeds to a point 406 wherein the accumulative air flow rate value Qs' is cleared to zero, and then to the end point 407.

The output control circuit 16 provides, to the fuel injectors, fuel-injection command pulses 16a having a predetermined repetition rate and a pulse width $T_i$. The pulse width $T_i$, which is calculated basically by adding a predetermined number of engine air flow rate values Q successively read at predetermined time intervals, corresponds to the integral of engine air flow. Thus, the flow of fuel from the fuel injectors to the engine will correspond to the engine air flow per unit time if the repetition rate of the trigger pulse signal 14a is equal to the time interval during which the predetermined number of engine air flow rate values Q are added. It is to be noted that the repetition rate of the trigger pulse signal 14a; that is, the fuel-injection interval should be shorter than the period of rotation of the engine crankshaft at its maximum speed since the fuel-injection timing is not dependent upon engine crankshaft rotation.

Assuming now that the computer program enters at the point 300 of the FIG. 3B diagram every 0.512 milliseconds and the computer program enters at the point 400 of the FIG. 3C diagram every 2.048 ($0.512\times4$) milliseconds and that the required accumulative total of the number of times that the engine air flow rate values Q were added is five, the repetition rate of the trigger pulse signal may be set at 10.24 ($2.048\times5$) milliseconds.

It can be seen from the foregoing that the fuel injection control system of the present invention can maintain the flow of fuel from fuel injectors to an internal combustion engine proportional to the flow of air to the engine without the use of an engine speed sensor, a reference pulse generator, and a data processing circuit therefor.

Figure 4:
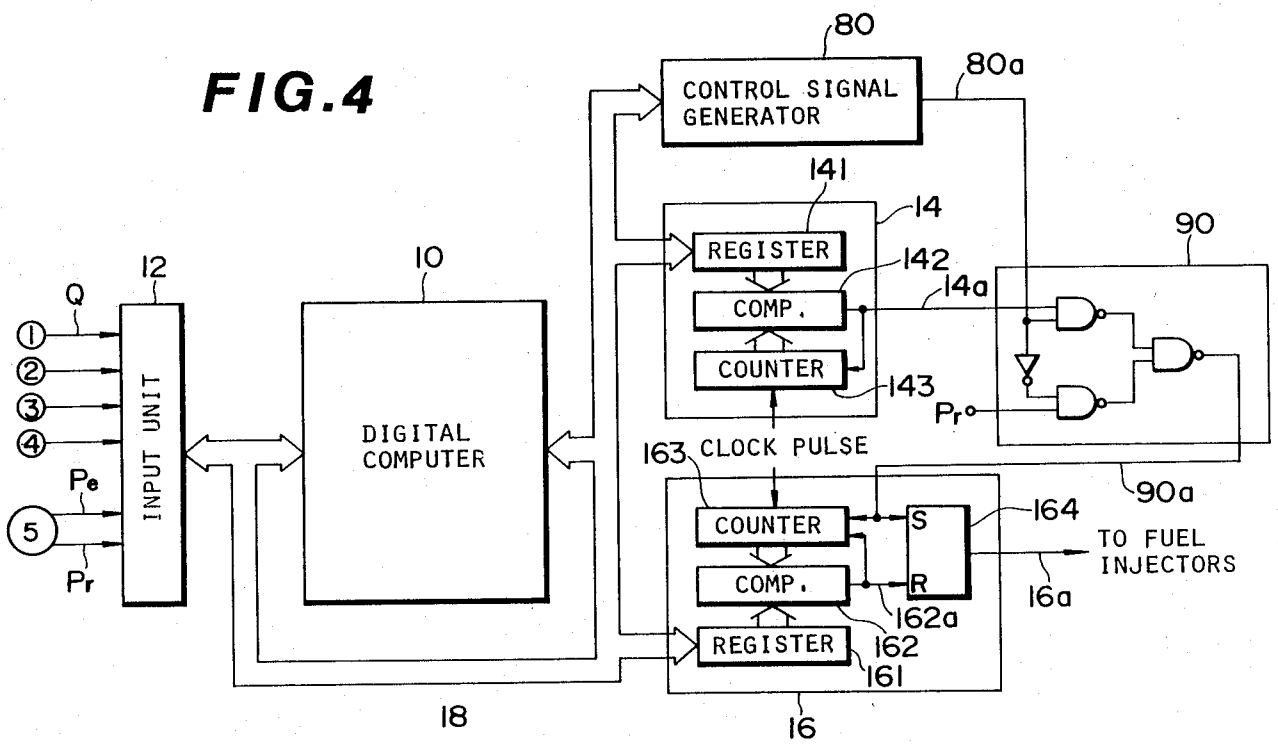
FIG. 4 is a schematic block diagram showing a second embodiment of the fuel injection control system of the present invention.

Referring to FIG. 4, there is illustrated a second embodiment of the fuel injection control system of the present invention wherein parts like those in FIG. 1 have been given the same reference numeral. The system includes a digital computer 10 which communicates via a bi-directional data bus 18 with an input control unit 12, a trigger pulse generator 14, an output control unit 16, and a control signal generator 80. The digital computer 10 includes a central processing unit, a read only memory, and a read/write memory and performs arithmetic calculations, based upon various engine operating conditions, to determine the amount of fuel metered to the engine, the fuel-injection timing, and other required engine operating functions.

The input control unit 12 is shown as having analog inputs from an airflow sensor 1, a battery voltage sensor 2, a coolant temperature sensor 3, and an oxygen sensor 4 as described in connection with FIG. 1. The input control unit 12 has an analog multiplexer and an analog-to-digital converter. The analog inputs to the analog multiplexer are, one by one, converted by an analog-to-digital converter into digital form and read into the computer memory via the data bus 18 on command from the digital computer 10. The input control unit 12 has additional inputs from a crankshaft position sensor 5 which generates (1) a series of crankshaft position electrical pulses $P_c$, each corresponding to one degree of rotation of the engine crankshaft, of a repetition rate directly proportional to engine speed, and (2) a reference electrical pulse $P_r$ at a predetermined number of degrees of rotation of the engine crankshaft, for example, every 120 degrees of crankshaft rotation for 6-cylinder engines.

The trigger pulse generator 14 has a timer circuit comprised of a register 141, a comparator 142, and a counter 143, for generating a trigger pulse signal 14*a* at a predetermined frequency. The register 141 stores, on command from the digital computer, a predetermined value which corresponds to the repetition rate of the trigger pulse signal 14*a*. The counter 143 counts clock pulses, advancing the count from zero at a predetermined rate. The comparator 142 resets the counter 143 to zero and at the same time generates a trigger pulse 14*a* each time the value of the count in the counter 143 reaches the predetermined value stored in the register 141. Thus, the time interval between the occurrence of successive trigger pulses 14*a* corresponds to the value stored in the register 141.

The output control unit 16 comprises a register 161, a comparator 162, a counter 163, and an R/S flip-flop 164. The register 161 stores, on command from the digital computer 10, a value which corresponds to the fuel-injection pulse-width value $T_i$ calculated by the digital computer 10 as will be described in detail. The counter 163 starts counting clock pulses, advancing the count from zero at a predetermined rate in response to a set signal 90*a* from a gate circuit 90. The set signal 90*a* is also coupled to the set terminal S of the flip-flop 164. The comparator 162 resets the counter 163 to zero and at the same time provides a reset signal 162*a* to the reset terminal R of the flip-flop 164 each time the value of the count in the counter 163 reaches the value stored in the register 161. The flip-flop 164 is set with the generation of the set signal 90*a* from the gate circuit 90 and is reset with the generation of the reset signal 162*a* from the comparator 162. Thus, the flip-flop 164 generates a fuel-injection command pulse signal 16*a* having a pulse width corresponding to the value stored in the register 161 and a repetition rate corresponding to the time interval between the occurrence of successive set pulses 90*a*. The fuel injection command signal is applied to fuel injectors for delivery of a desired amount of fuel to the engine.

The control signal generator 80 comprises a register and a buffer for generating a control signal 80*a* which is changed between low and high levels under the control of the digital computer 10. The control signal 80*a* is coupled to the gate circuit 90 which receives at its one input the trigger pulse signal 14*a* from the trigger pulse generator 14 and at the other input the reference pulse signal $P_r$ from the crankshaft position sensor. The gate circuit 90 responds to a high level control signal 80*a* for passing the trigger signal 14*a* from the trigger pulse generator 14 to the output control unit 16. The gate circuit 90 passes the reference pulse signal $P_r$ from the cranshaft position sensor to the output control unit 16 in response to a low level control signal 80*a*.

The digital computer 10 normally maintains the control signal 80*a* at its low level and changes the control signal 80*a* from the low level to a high level when a failure occurs in the crankshaft position sensor or the associated data processing circuit. The digital computer 10 judges such a failure and changes the control signal 80*a* to its high level when the repetition rate $T(P_r)$ of the reference pulse signal $P_r$ is equal to or longer than a reference value $T_{ref}$ that may be set at a value corresponding to a reference pulse signal repetition rate obtained at an engine speed ranging from 20 rpm to 40 rpm. Alternatively, the digital computer 10 may be arranged to judge such a failure by comparing an engine speed value calculated in terms of the reference pulse signal $P_r$ with an engine speed value obtained in terms of the crankshaft position pulse signal $P_c$. The engine speed can be obtained by counting the number of occurrences of the crankshaft position pulses $P_c$ for a predetermined time, for example, of 10.85 microseconds or by arithmetically calculating the reciprocal of the repetition rate of the reference pulses $P_r$.

Normally, the control signal generator 80 provides a low level control signal 80*a* to the gate circuit 90 which thereby passes the reference pulse signal $P_r$ from the crankshaft position sensor to the output control unit 16. This causes the counter 163 to start counting clock pulses and at the same time sets the flip-flop 164. The flip-flop 164 is reset when the value of the count in the counter 163 reaches the value stored in the registor 161. Thus, the flip-flop 164 generates a fuel-injection command pulse signal 16*a* having a pulse width corresponding to the fuel-injection pulse-width value $T_i$ at a repetition rate corresponding to that of the reference pulse signal $P_r$. In this case, the fuel-injection pulse-width value $T_i$ is determined by the digital computer in terms of engine air flow rate and engine speed as will be described in detail.

If a failure occurs in the crankshaft position sensor or the associated data processing circuit, the control signal 80*a* will shift from the low level to its high level, causing the gate circuit 90 to block the reference pulse signal $P_r$ and instead pass the trigger pulse signal 14*a* from the trigger pulse generator 14 to the output control unit 16. As a result, the counter 163 starts counting clock pulses and the flip-flop 164 is set. The flip-flop 164 is reset when the value of the count in the counter 163 reaches the value stored in the registor 161. Thus, the flip-flop 164 generates a fuel-injection command pulse signal having a pulse width corresponding to the fuel-injection pulse-width value $T_i$ at a repetition rate corresponding to that of the trigger pulse signal 14*a;* that is, the value stored in the register 141. In this case, the fuel-injection pulse-width value $T_i$ is determined by the digital computer in terms of engine air flow rate as will be described in detail.

Figure 5:
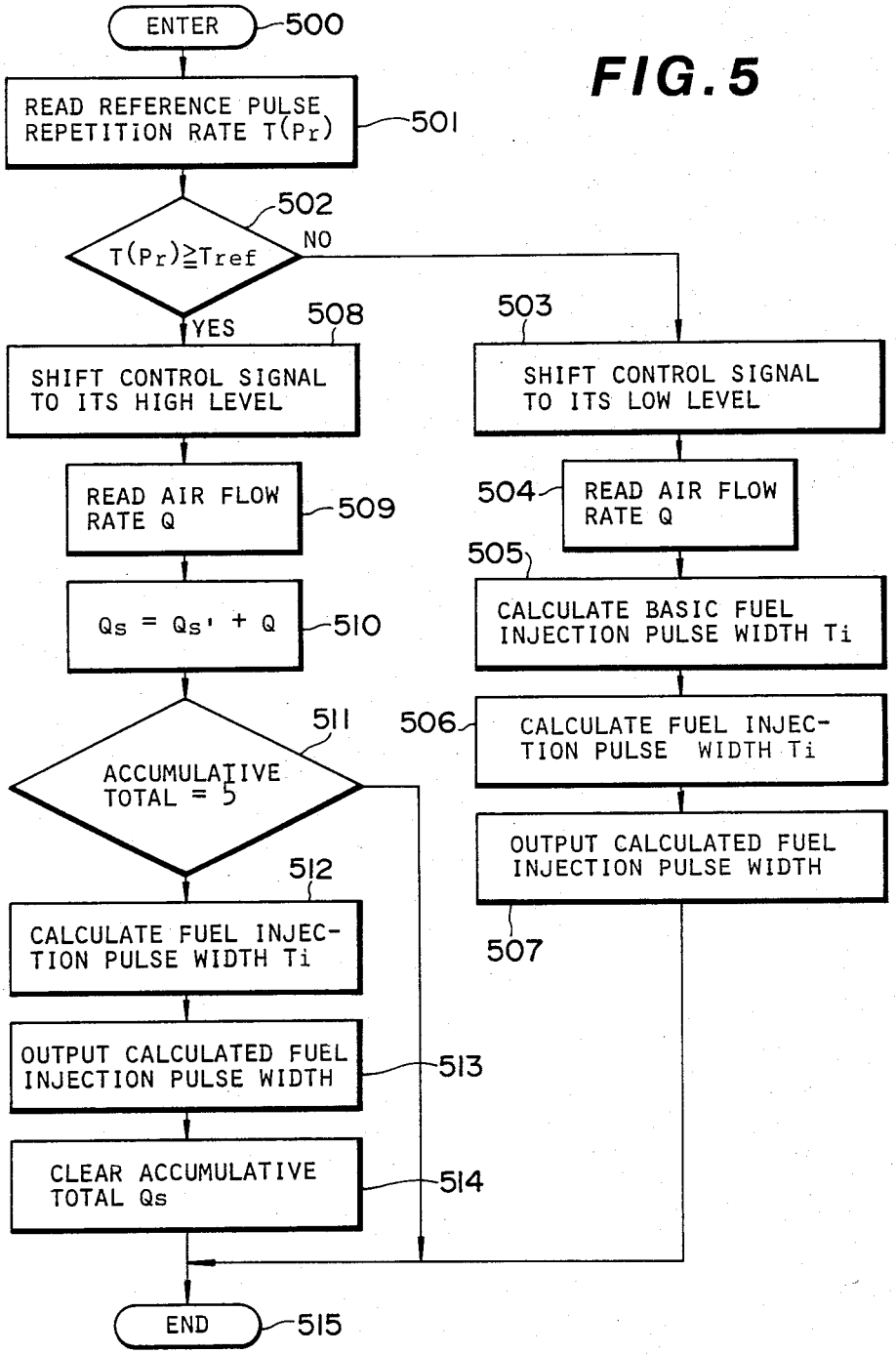
FIG. 5 is a flow diagram illustrative of the operation of the digital computer used in the system of FIG. 4 to arithmetically calculate values for the fuel-delivery requirements in the form of fuel-injection pulse-width and injection timing.
Figure 6:
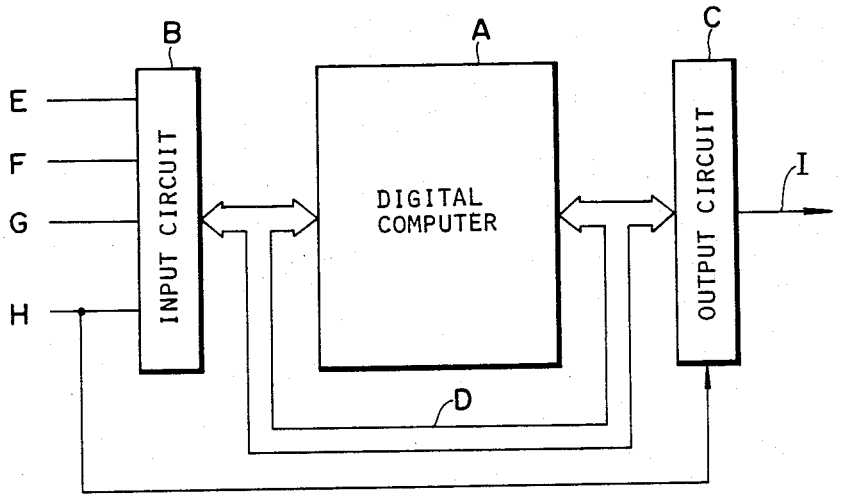
FIG. 6 PRIOR ART
FIG. 6 is a schematic block diagram of a conventional fuel injection control system.

FIG. 5 is a flow diagram illustrative of the operation of the digital computer 10 used in the system of FIG. 4 to arithmetically calculate values for the fuel-delivery requirements in the form of fuel-injection pulse-width and injection timing. The computer program is entered at the point 500 upon the occurrence of an interrupt signal which is generated from the input control unit timer to the digital computer central processing unit at a predetermined frequency. At the point 501 in the program, the repetition rate value $T(P_r)$ of the reference pulse signal $P_r$ is read into the computer memory. At the following point 502, a determination is made as to whether or not the read repetition rate value $T(P_r)$ is equal to or larger than a reference value $T_{ref}$.

If the answer to this question is no, the program proceeds to a point 503 wherein the control signal 80*a* is held at or changed to its low level. At the point 504, the engine air flow rate value Q is read into the computer memory. Following this, the program proceeds to a point 505 wherein the digital computer calculates the basic value $T_p$ for fuel-injection pulse width by dividing the engine air flow rate value Q by the engine speed value N. Then, at the point 506 the fuel-injection pulse-width value $T_i$ is calculated by multiplying the calculated fuel-injection pulse-width basic value $T_p$ by the correction factor C which is obtained in the process at the point 203 of the FIG. 3A diagram. Following this, the computer program proceeds to a point 507 wherein the calculated fuel-injection pulse-width value $T_i$ is outputted to the register 161 and then to an end point 515.

If the answer to the question at the point 502 is yes, then the program proceeds to a point 508 wherein the control signal 80*a* is held at or changed to its high level. At the point 509 in the program, the engine air flow rate value Q is read into the computer memory and then at the point 510 the digital computer calculates an accumulative engine air flow rate value Qs by adding the read engine air flow rate value to the previously accumulated engine air flow rate value Qs'. Following this, the program proceeds to a determination step at a point 511. The determination is whether or not the accumulative total of the number of times that the engine air flow rate values were added is five. If the answer to this question is no, the program proceeds to the end point 515. Otherwise, the program proceeds along the YES line to a point 512 wherein the digital computer calculates a fuel-injection pulse-width value $T_i$ by multiplying the calculated accumulative engine air flow rate values Qs by the correction factor C obtained at the point 203 of the FIG. 3*a* program. At the point 513, the calculated fuel-injection pulse-width value $T_i$ is outputted to the register 161. Following this, the program proceeds to a point 514 wherein the accumulative air flow rate value Qs is cleared to zero, and then to the end point 515.

In this embodiment, the fuel injection control system responds to a failure in the crankshaft position sensor or the associated circuit for shifting its operation from a first mode wherein fuel injection command pulses, the pulse width of which is calculated from a relationship defining fuel-injection pulse-width as a function of engine air flow rate and engine speed, are generated in synchronism with engine rotation to a second mode wherein fuel injection command pulses, the pulse width of which is calculated from a relationship describing fuel-injection pulse-width as a function of engine air flow, at a predetermined frequency. Thus, the engine is kept free from engine troubles which would result from such a failure.

While the present invention has been described in conjunction with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. A fuel injection control system for use in an internal combustion engine having at least one fuel injector, comprising:

an airflow sensor for generating a signal indicative of the flow rate of air to said engine;

a digital computer receiving the engine air flow rate indicative signal from said airflow sensor for reading engine air flow rate values, said digital computer calculating a fuel-injection pulse-width value from the read engine air flow rate values;

a trigger pulse generator for generating a series of trigger pulses at a predetermined constant repetition rate shorter than the period of rotation of said engine at its maximum speeds;

an injection command signal generator for generating an injection command pulse having a pulse width corresponding to the calculated fuel-injection pulse-width value to said fuel injector each time an injection initiation pulse is received; thereby controlling the supply of fuel to said engine;

a reference pulse generator for generating a series of reference pulses in synchronism with engine rotation;

a control signal generator for generating a control signal changeable between low and high levels; and a gate circuit having inputs from said trigger pulse generator and said reference pulse generator, said gate circuit, responsive to a high level control signal from said control signal generator, for passing trigger pulses as said injection initiation pulses from said trigger pulse generator to said injection command signal generator, said gate circuit, responsive to a low level control signal from said control signal generator, for passing reference pulses as said injection initiation pulses from said reference pulse generator to said injection command signal generator;

said digital computer normally reading engine speed values from the reference pulses, calculating the fuel-injection pulse-width value by dividing the read air flow rate value by the read engine speed value, and holding the control signal at its low level, said digital computer changing the control signal to its high level and calculating the fuel-injection pulse-width value by adding a predetermined number of engine air flow rate values successively read at predetermined intervals when a failure occurs in said reference pulse generator or the associated circuit, said predetermined repetition rate of said trigger pulse generator being based on the time interval during which the predetermined number of engine air flow rate values are added.

2. A fuel injection control system according to claim 1, wherein said digital computer changes the control signal to its high level and calculates the fuel-injection pulse-width value by adding a predetermined number of engine air flow rate values successively read at the predetermined intervals when the repetition rate of the reference pulses exceeds a predetermined value.

3. A fuel injection control system according to claim 1, wherein said reference pulse generator generates a first series of pulses at one degree of rotation of an engine crankshaft and a second series of pulses at a predetermined number of degrees of rotation of said engine crankshaft, and wherein said digital computer calculates a first engine speed value from the first series of pulses and a second engine speed value from the second series of pulses, said digital computer changing the control signal to its high level and calculating the fuel-injection pulse-width value by adding a predetermined number of engine air flow rate values successively read at the predetermined intervals when a difference occurs between said first and second engine speed values.

4. A fuel injection control system according to claim 1, wherein said digital computer calculates the fuel-injection pulse-width value from an algebraic relationship defining fuel-injection pulse-width as a function of engine air flow, engine speed, coolant temperature, vehicle battery voltage, and exhaust gas oxygen concentration.

* * * * *